US012366420B2

(12) United States Patent
Fitzgerald et al.

(10) Patent No.: US 12,366,420 B2
(45) Date of Patent: Jul. 22, 2025

(54) RADIATOR AND JOINT

(71) Applicant: Transportation IP Holdings, LLC, Norwalk, CT (US)

(72) Inventors: George Wilson Fitzgerald, Northampton (GB); Anthony Roberts, Northampton (GB); Martin Richardson, Northampton (GB); Thomas Snelling, Northampton (GB); Balaji Hosadurgam Ravindranath, Mysore (IN); Leigh David, Northampton (GB)

(73) Assignee: Transportation IP Holdings, LLC, Norwalk, CT (US)

( * ) Notice: Subject to any disclaimer, the term of this patent is extended or adjusted under 35 U.S.C. 154(b) by 58 days.

(21) Appl. No.: 18/332,433

(22) Filed: Jun. 9, 2023

(65) Prior Publication Data

US 2024/0210126 A1 Jun. 27, 2024

(30) Foreign Application Priority Data

Dec. 21, 2022 (IN) ..... 202211074105

(51) Int. Cl.
*F28F 9/02* (2006.01)

(52) U.S. Cl.
CPC ..... *F28F 9/0248* (2013.01); *F28F 2275/06* (2013.01)

(58) Field of Classification Search
CPC ..... F28F 9/0248; F28F 2275/06
USPC ..... 165/173
See application file for complete search history.

(56) References Cited

U.S. PATENT DOCUMENTS 6,688,014 B1 2/2004 Allemand
2001/0004153 A1* 6/2001 Byrnes ..... F16L 43/00 285/179
2021/0333056 A1* 10/2021 Butcka ..... B33Y 40/20

FOREIGN PATENT DOCUMENTS

KR 100773339 B1 * 11/2007
RU 2194908 C1 * 12/2002

OTHER PUBLICATIONS

RU-2194908-C1 (Babanov et al.) (Dec. 20, 2002) (Machine Translation) (Year: 2002).*
Search Report mailed Dec. 5, 2023 for corresponding Great Britain Application No. GB2309480.8 (3 pages).

* cited by examiner

*Primary Examiner* — Mahmoud Gimie
(74) *Attorney, Agent, or Firm* — K&L Gates LLP

(57) ABSTRACT

A radiator joint is provided that include a first component, a second component and a weld seam, that together define a bird beak joint. The first component has generally circular cross-sectional profile. At an end of the first body there is a bird beak cut section that forms a first mating surface. The second component can function as a manifold. It has a generally rectangular cross sectional profile and an aperture. The aperture extends along at least two sides of the second component. The weld seam is disposed at the first mating surface and couples the first component to the second component. A fluidic seal is thereby formed between the hollow interior and the exterior while defining a fluid flow path through the first and second components.

20 Claims, 9 Drawing Sheets

RADIATOR AND JOINT

CROSS-REFERENCE TO RELATED APPLICATIONS

This application claims priority to Indian Patent Application No. 202211074105 (filed 21 Dec. 2022), the entire disclosure of which is incorporated herein by reference.

BACKGROUND

Technical Field

Embodiments of the subject matter disclosed herein relate to a connection joint for a radiator, and the radiator.

Discussion Of Art

Bird beak or birdsmouth joints are known joints that may be used in woodworking. In light frame construction, a birdsmouth joint or bird's beak cut may include a woodworking joint that may be used to connect a roof rafter to the top plate of a supporting wall. The joint can include an indentation cut into the rafter that is formed from a seat cut (e.g., a face of which rests on the top plate) and a heel cut or plumb cut (e.g., a face of which lies parallel to the supporting wall), thereby having the shape of a bird's mouth. The indentation may not extend unsupported on the interior to maintain structural integrity of the rafter as any unsupported section may split along wood grain. The joint may be fastened with nails by toenailing the rafter from the side into the top plate below.

As tubular structures have become useful in construction, hollow metal tubes have adopted the approach as bird beak joints in addition to standard tubular joints. Recently, a joint configuration called bird-beak has been adopted, in part because researchers have found that member orientation has an influence on stress and strain resistance of joints. There are two traditional types of bird-beak joints: the square bird-beak joint which is obtained from rotating the chord of a traditional joint through 45° about its longitudinal axis, and the diamond bird-beak joint which is achieved by rotating both the chord and braces of a traditional joint through 45° about their longitudinal axes.

Hollow structural sections, or HSS, may include round, rectangular, or square tubes having shapes that may provide inherently higher strength and may be able to span greater lengths between braces than traditional beams. A square steel tube with a 3/16-in.-thick wall thickness has an allowable load of 79 kips over a column length of 32 ft., while a similar wide flange (ASTM designation of W12×40) has an allowable load of 64 kips over the same column length. What is not seen is the mixing of rectangle and circular tubes, nor the use of bird beak joints outside of woodworking and structural build applications. Some reasons for this are that the stress and load modeling is challenging, and the straightforward approach is to simply over-engineer any parts that do not have sufficient safety margin.

Fatigue behavior of the traditional hollow tube joint may include crack initiation, crack propagation, metal fatigue life, and stiffness degradation. High-cycle fatigue behavior may include crack initiation and propagation, metal fatigue, and rigidity degradation. It is believed that cracks initiate at locations with greatest stress concentration factors (SCFs). Those locations may be at an overlap region and at the brace crown area for square and diamond bird-beak joints, respectively. Maximum SCFs of square bird-beak overlapping K-joints can occur at the brace overlap areas, while the maximum SCFs of other joints may appear at the brace crown areas. These different joints can behave differently from each other in response to structural loading. It may be desirable to apply the joint connection method to otherwise overlooked applications.

BRIEF DESCRIPTION

In one example, a connection (or connection assembly) for a radiator is provided. The connection can include a first component that can operate as an inlet or outlet. The first component may have a first body with a hollow generally circular cross-sectional profile, a main portion that is centered on a main axis, and a second portion that is centered on a second axis that is angled relative to the main axis in a range of about 25 degrees to about 90 degrees. The first component can include a bird beak cut section forming a first mating surface at an end of the first body. The connection also can include a second component that can operate as a manifold. The second component may have a second body with a generally rectangular cross sectional profile and an inner surface that defines both a hollow interior and an aperture. The aperture can extend along at least two sides of the second component, and be defined by a portion of the inner surface of the second body. The aperture or the portion of the inner surface of the second body that defines the aperture can be angled relative to a planar surface of the second body at non-perpendicular angle. The aperture may have a diameter that is sized to matingly couple to (e.g., mate with) the first mating surface of the first component. The connection also can include a weld seam disposed at the first mating surface and that can couple the first component to the second component to form a fluidic seal between the hollow interior of the second component and an exterior area while defining a fluid flow path through the first and second components.

In another example, a radiator (or radiator assembly) can include the connection described above. The first and second components may be formed from steel, aluminum, brass, or the like. The weld seam can seal the first mating surface to prevent fluid from flowing from inside the radiator to outside the radiator via the joint between the first component and the second component. The weld seam may resist more than 500 thermal cycles without cracking, and more than 200 pounds per square inch (PSI) of fluid pressure without leaking.

In another example, a radiator (or radiator assembly) is provided. This radiator may include a first component that can operate as an inlet or outlet. The first component may have a hollow first body with a generally circular cross-sectional profile. The first component can have a main portion that is centered on a main axis and a second portion that is centered on a second axis that is angled relative to the main axis by an amount in a range of about 25 degrees to about 90 degrees. The first component may include a bird beak cut section at an end of the first body that forms a first mating surface. The radiator may include a second component that can operate as a manifold. The second component may have a hollow second body with a generally rectangular cross sectional profile and an inner surface that defines an aperture. The aperture can extend along at least two sides of the second component and be defined by a portion of the second body inner surface and relative to a planar surface of the second body being angled other than perpendicular. The aperture can have a diameter sized to matingly couple to the first mating surface. The radiator also may include a weld seam disposed at the first mating surface and that can couple the first component to the second component to thereby form a fluidic seal between the hollow interior and an exterior space while defining a fluid flow path through the first and second components, the first component, the second component. The weld seam can define a bird beak joint.

DETAILED DESCRIPTION

Embodiments of the inventive subject matter are disclosed in the following description and relate to a connection or joint in a radiator, and a radiator having such a joint. The connection or joint may be a birdsmouth or bird beak joint that couples a circular pipe to a hollow rectangular tube. A suitable coupling method can be welding, and the angle of the bevel on the rectangular portion may provide a good base for mechanical support of the weld seam.

Figure 1:
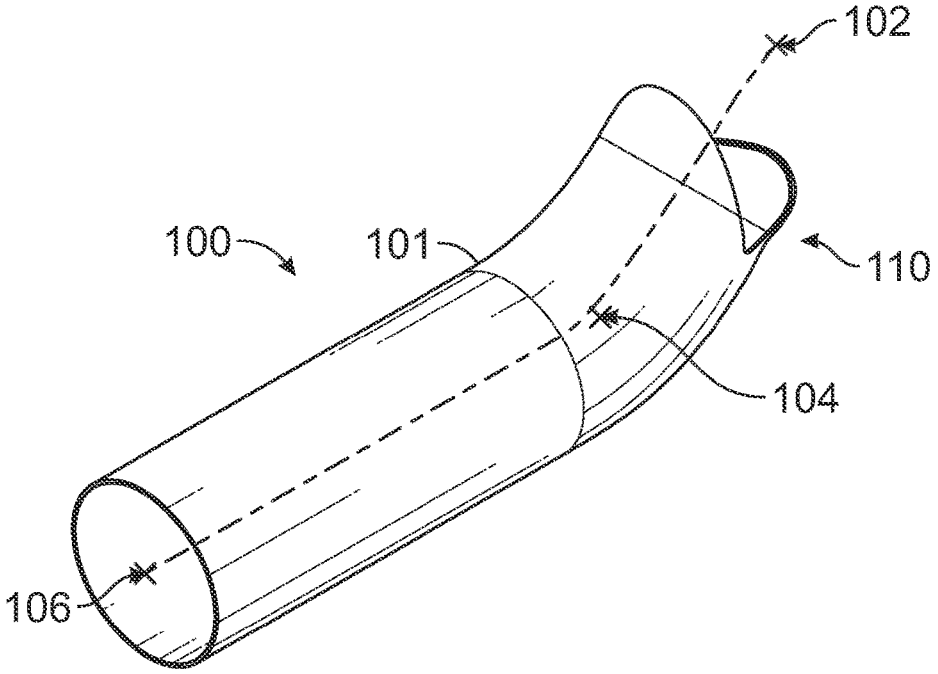
FIG. 1 is a perspective view showing one example of a pipe component.
Figure 2:
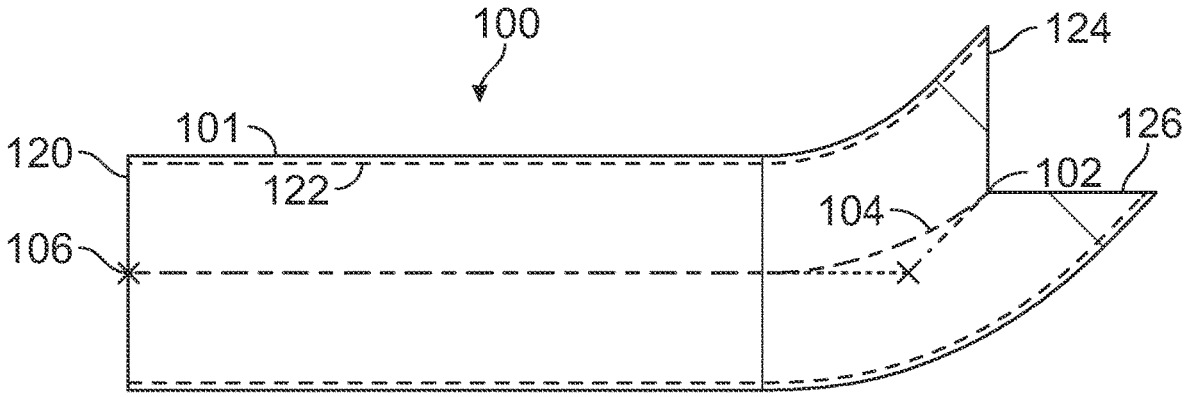
FIG. 2 is a side view of the component shown in FIG. 1.
Figure 3:
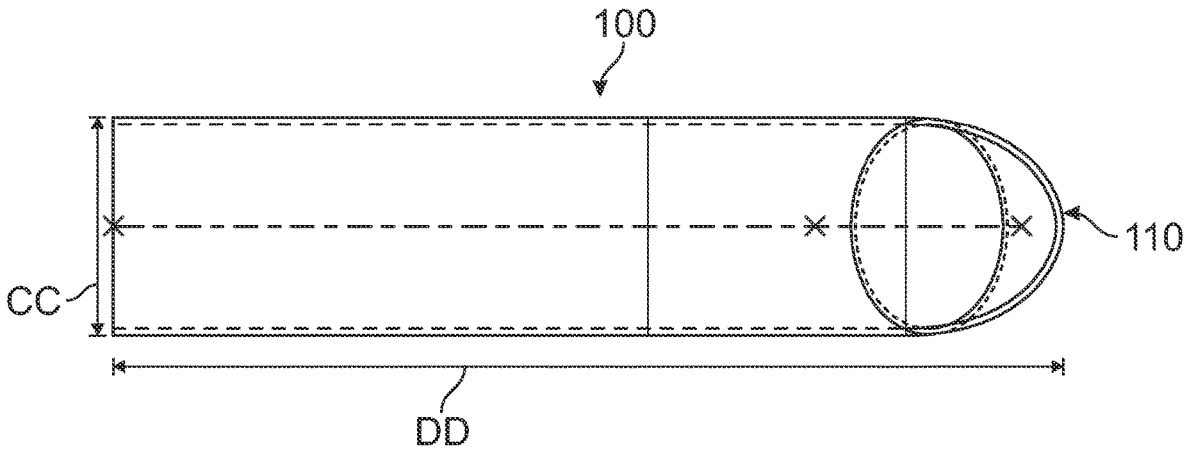
FIG. 3 is a top view of the component shown in FIG. 1.

With reference to FIGS. 1-3, a first component 100 that illustrates a portion of an embodiment of the inventive subject matter is shown. The first component may have a body 101 that forms a conduit (e.g., a pipe or the like) with a generally circular cross-sectional profile. Alternatively, the cross-sectional profile may be oval, oblong, ellipsoidal, or the like. The body may have a bend point 104 where the conduit changes direction so that a centerline axis 102 of the conduit after the bend angles away from a centerline axis 106 of the main body by 135 degrees. For example, different segments of the body may be centered or otherwise extend along different axes, with the axes being oriented at an obtuse angle relative to each other. Other embodiments may have another angle (e.g., another obtuse angle, an acute angle, etc.) selected with reference to end use requirements.

Figure 4:
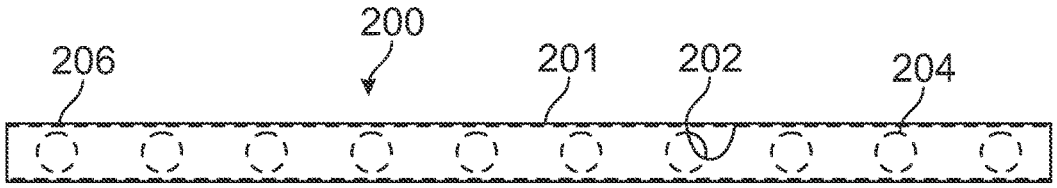
FIG. 4 is a top view of one example of a hollow rectangular tube component.
Figure 5:
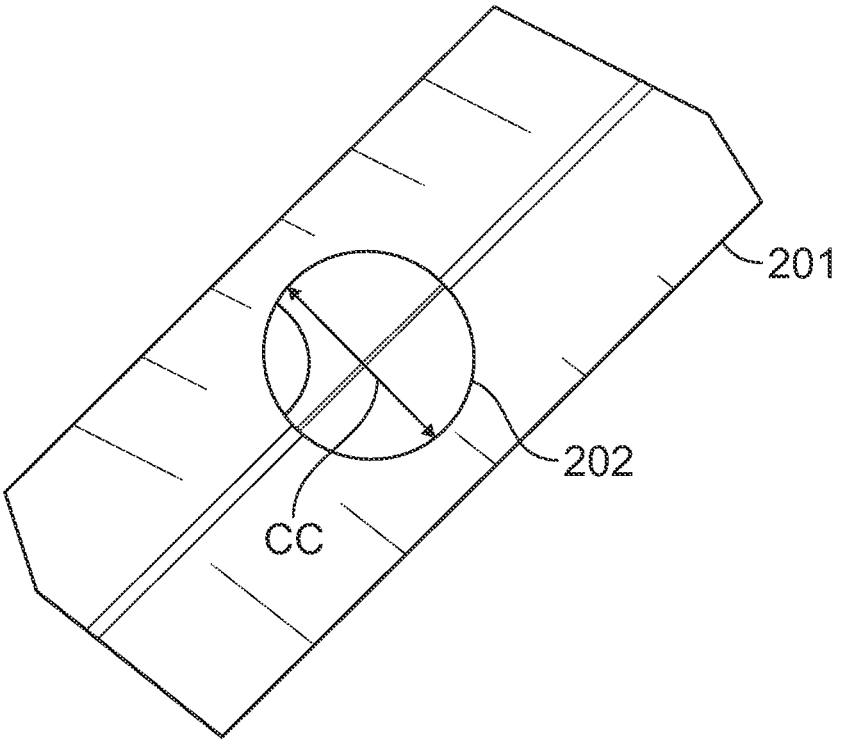
FIG. 5 is a perspective view of a section of the tube component shown in FIG. 4.
Figure 6:
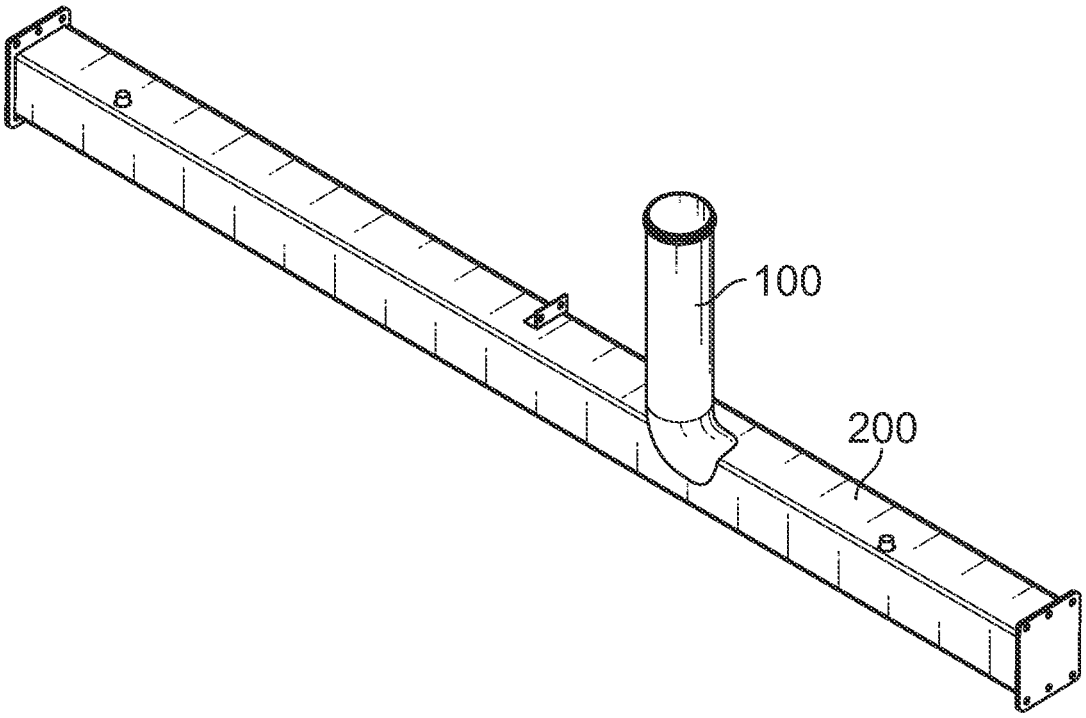
FIGS. 6 through 14 illustrate additional views of the pipe component joined with the rectangular tube component by a birdsmouth or bird beak joint.
Figure 7:
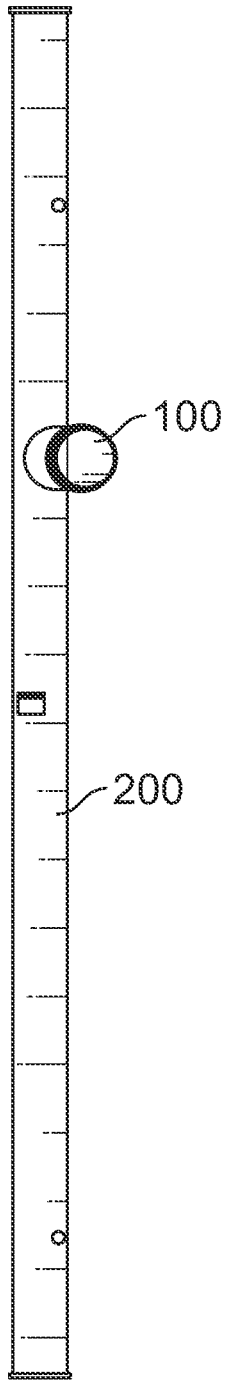
Figure 8:
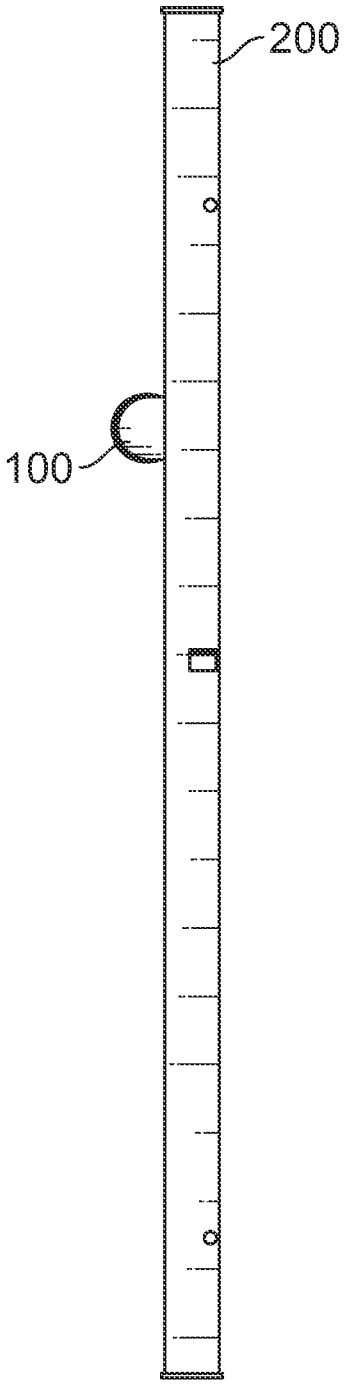
Figure 9:
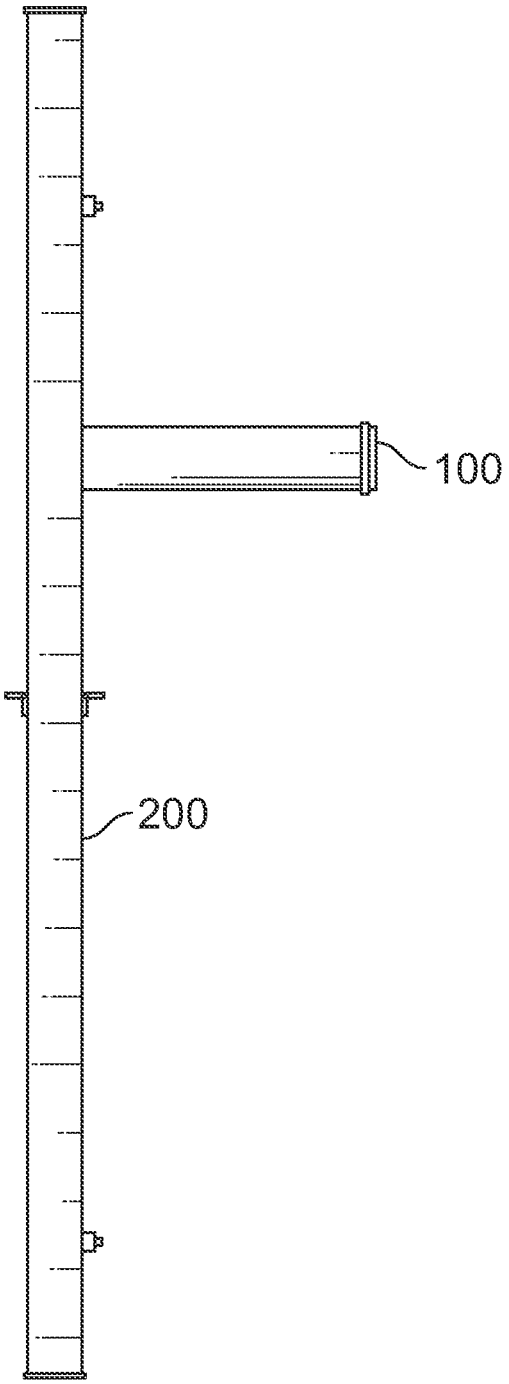
Figure 10:
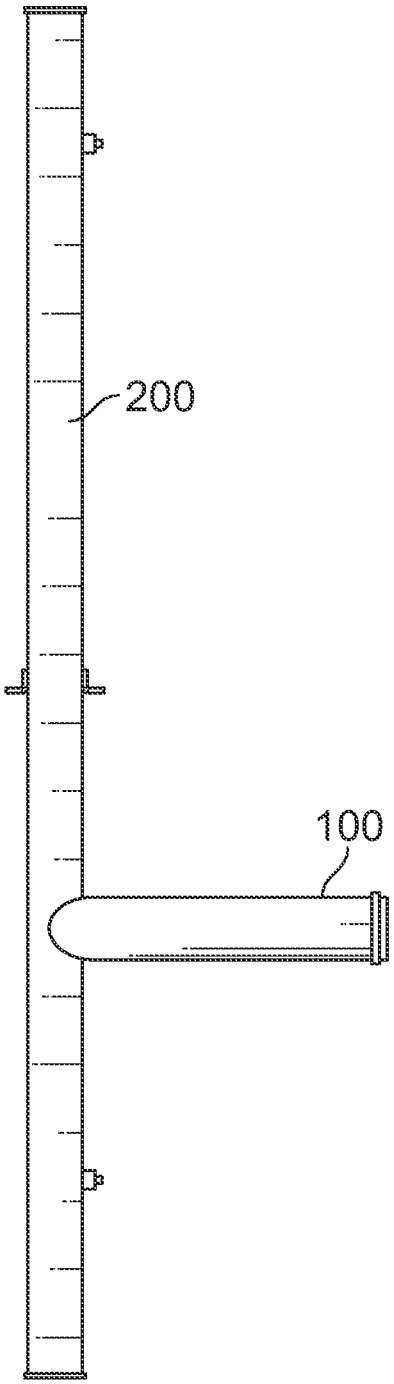
Figure 11:
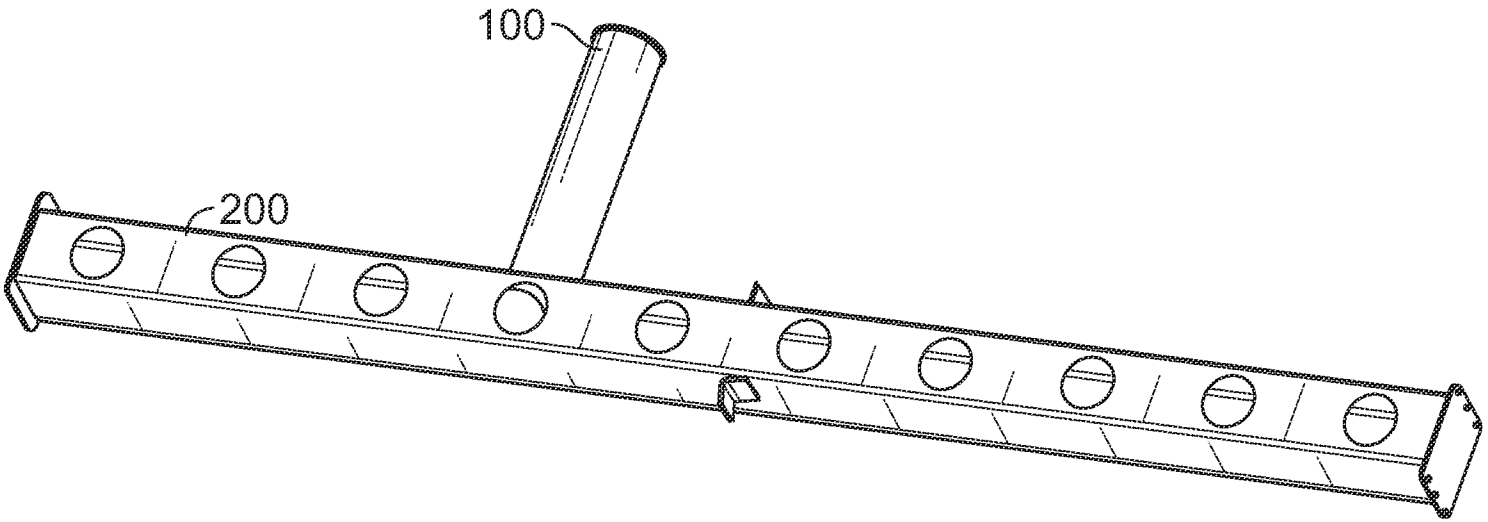
Figure 12:
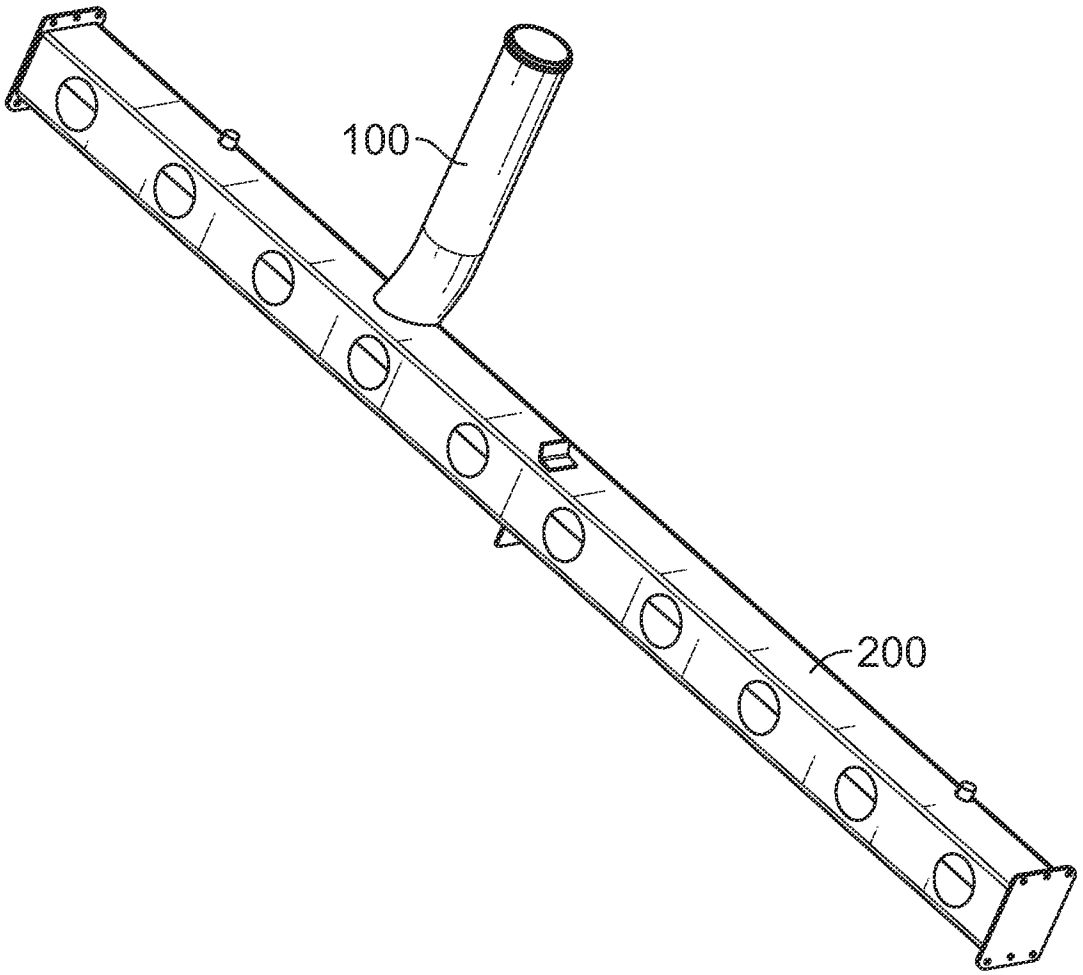
Figure 13:
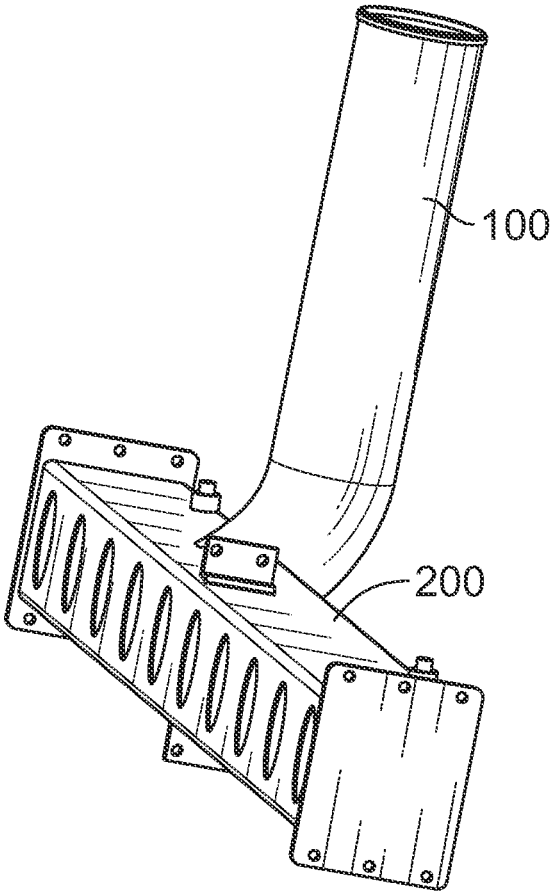
Figure 14:
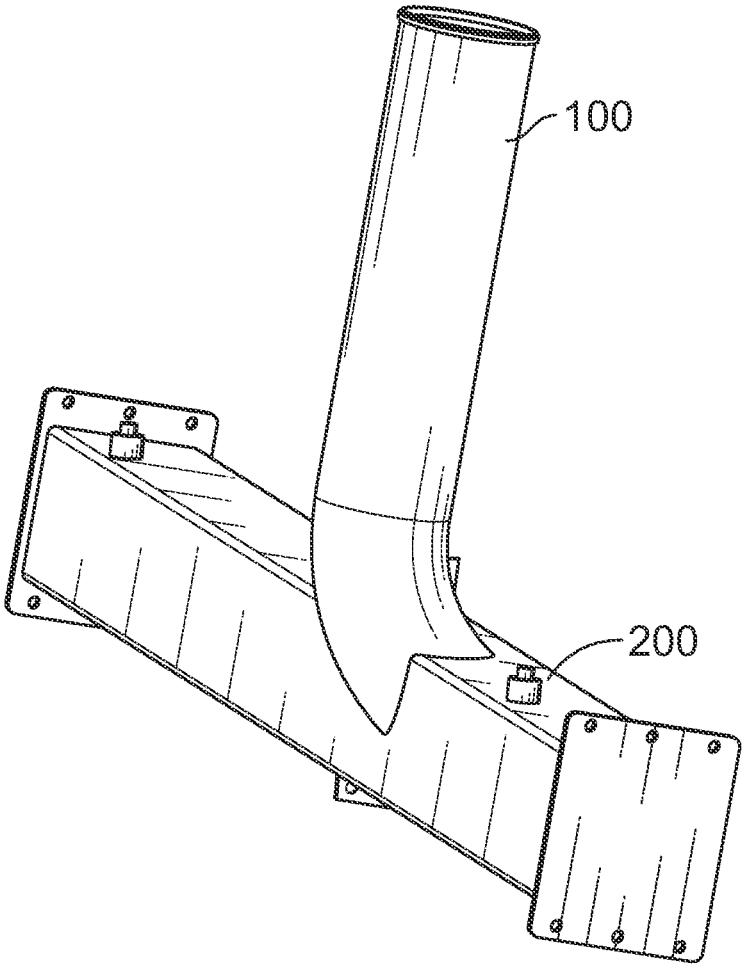

A proximate end 110 of the first component may have a 90 degree cut, with the cut selected to correspond to an angle of the body of a second component 200 (FIGS. 4-5). Because the second component may have sides that are oriented at a right angle, the bird beak cut also may be a right angle (as described herein). The first component body may have a first thickness 120 and an inner wall 122 that can define an inner flow path for a thermal fluid through the first component. This thermal fluid optionally may be a working fluid that transfers thermal energy (e.g., heat or cold) between two or more bodies, components, machines, equipment, etc. The first component body may have a main length AA from the distal end to the bend and may have a secondary length BB from the bend to the closest point of the proximate edge.

The bird beak cut may have an upper face 124 and a lower face 126, divided at the angled transition of the face (e.g., an angled transition between the upper face and the lower face such that the upper face and the lower face, or upper edges and lower edges of the cut, are oriented at an angle relative to each other and are not parallel to each other). Upper and lower are simply distinguishing terms relative to the bend and do not denote orientation during use in all embodiments. An outer diameter or width of the first component is labeled as CC, and the overall length of the first component is denoted with DD. The distal end may be swaged to form a lip, which may facilitate coupling of hoses or tubes thereto.

With reference to FIGS. 4-5, a second component 200 has a body 210 that is shown as a hollow rectangular conduit, such as a tube. An aperture 202 may be defined by this body along two of the sides of the body. A series of additional apertures 203 may open into the second component on a side that is opposite at least a portion of the aperture. The aperture may be sized so that the aperture about matches contours of the bird beak face of the first component (124, 126) and forms a mating surface. In the illustrated embodiment, the inner surface 206 of the second component may both define the aperture and may be beveled or angled relative to the surface(s) of the second component. This inner surface can be sized slightly larger than the diameter CC of the first component. In one example, a ratio of the inner diameters (also referred to as cross-sectional fluid areas) of the components may be 0.2 to 1.2. For example, the ratio of the cross-sectional fluid area of the first component to the second component can range between 0.2 to 1.2. The angle may be selected such that there is relatively increased contact area when the first component is inserted compared to the aperture being defined by edges that are perpendicular to the planer surfaces of the second component.

In another embodiment, the aperture can be sized slightly smaller than the first component diameter, and the bird beak faces (124, 126) may abut the second component but may not enter the aperture. In yet another embodiment, the aperture size and the first component diameter may be selected to form a press fit. For example, the first component may be cooled (to slightly reduce the diameter of the first component) and inserted into the aperture. While temperatures of the components equalize, the first component may expand to seal to the second component even before any other sealing technique is employed.

Suitable diameters for the first component may be in a range of from about 75 millimeters (mm) to about 105 mm. In one embodiment, the pipe may have a diameter that is about 100 mm, and in another embodiment, the pipe may have a diameter of about 75 mm. The wall thickness of the first component may be in a range of from about 1 mm to about 10 mm. In one embodiment, the first component wall thickness may be about 1.5 mm, and in one embodiment may be about 2.5 mm, and in another embodiment, may be about 3 mm. The weld seam may have a thickness selected with reference to the wall thick of the first component, the second component, or both the first and second components. This may be further based at least in part on the material(s) selection, the weld type, and the end use application. During operation, the weld seam according to one embodiment may resist more than 500 thermal cycles without cracking, and more that 200 PSI without leaking due to one or more, or all, these dimensions being used and/or the materials being used.

The first and second components may be formed from the same material in the illustrated embodiment. In other embodiments, the first and second component can be formed from materials that differ from each other. Suitable materials may include steel, aluminum, titanium, and cermets (ceramic metals). Suitable steels may include galvanized and stainless, as well as mild, high carbon, and ductile steel, alloys of the foregoing, and the like. The selection of metal may be a factor in the selection of weld materials and weld techniques. Using the illustrated embodiment with steel components, suitable welding techniques may include energy sources that include a gas flame (chemical), an electric arc (electrical), a laser, an electron beam, friction, and ultrasound. These may allow for laser beam welding, electron beam welding, magnetic pulse welding, and friction stir welding. Brazing and soldering may be selected with reference to end use requirements. Suitable weld configurations (butt, full penetration, fillet, etc.) may result in a butt joint, lap joint, corner joint, edge joint, or T-joint (a variant of this last is the cruciform joint). These may be selected with reference to the end use requirements. During the welding, the heat-affected zone (HAZ) may be controlled. The HAZ can include a ring surrounding the weld in which the temperature of the welding process, combined with the stresses of uneven heating and cooling, may alter the heat-treatment properties of the component's alloy.

During manufacture, the first component and the second component may be surface treated and cleaned, and then placed in contact so that (in this embodiment) the first component enters the aperture at about 45 degrees (e.g., the same angle as the aperture side walls) and the components are in contact with each other having complimentary inner/outer diameters. Optionally, an inert gas may be flowed through the second component manifold and out through the first component during the welding. A lap joint configuration may be used during a MIG welding process that can add metal content to the weld seam. The weld seam may be a smooth blend, and convex (although a concave profile may be selected for use in some applications), and the toe of the weld seam may not coincide with a tangent of the outer surface of the first component (e.g., the pipe). The resulting product can couple a circular pipe to a rectangular tube in structurally robust manner.

EXAMPLES

A radiator having a bird beak joint according to an embodiment of the invention may exhibit relatively low fatigue behavior as compared to traditional hollow tube joint. Although structural tubing and fluidic piping differ, on comparison, examples of the instant invention show little to no crack initiation, crack propagation, metal fatigue, or stiffness degradation after multiple cycles—thermal cycles, stress cycles, vibrations, and impact. High-cycle fatigue behavior involving crack initiation and propagation, metal fatigue and rigidity degradation is not observed.

Modeling shows SCFs at the overlap region and at the brace crown area that are relatively lower than for structural tubing (rectangle to rectangle) square and diamond bird-beak joints. SCF is the ratio of the highest stress in the part compared to a reference stress and is a dimensionless number. Accordingly, examples of embodiments show relatively even stress distribution across the weld seam, and the bird beak joint. This stress distribution is evenly distributed through the radiator components (first and second components) initially, and after a standard radiator duty cycle.

According to an embodiment includes a method of controlling, reducing or eliminating leaks from a radiator. The method includes providing first and second radiator components. The first component is a pipe having a circular cross-sectional profile. The second component is a hollow rectangular tube. The first component has a bird beak cut, and the second component has an aperture that is sized to couple to the bird beak cut. The method includes coupling the first and second components together to form a bird beak joint. During use, thermal fluid flows through the first and second components, with the second component having a plurality of additional apertures for which it acts as a manifold.

A suitable radiator may include an intake, an outlet, a manifold, a core, a valve cover, and a nozzle extending from and in fluid communication with the valve cover and the core. A suitable nozzle may be defined by a cylindrical sidewall having an end that can form a seal with a radiator tank. A sleeve may be mounted around a portion of the cylindrical sidewall of the nozzle. The sleeve may be formed of a corrosion resistant material. Suitable corrosion resistant materials may include brass, stainless steel, and anodized aluminum. In some applications the material may be selected to have corrosion resistant, non-reactive materials that are selected based at least in part on the thermal fluid and the use temperatures. A retaining gel may be applied to the seal. During use, the retaining gel may block or prevent coolant from entering the seal. The nozzle and valve cover may be aluminum. A suitable retaining gel may be a methacrylate retaining gel.

A suitable sleeve may include a flared flange at a first end. The flair may facilitate mounting the sleeve to the valve cap such that the flared flange is positioned proximate a flat portion of the valve cap. The sleeve may include an inner lip at the second end opposite the flared flange at the first end. The sleeve may have a predetermined height such that the inner lip is slightly below the end of the nozzle when the sleeve is installed on the nozzle. This design may smooth transition from the end of the nozzle to the sleeve. The sleeve may have a determined diameter such that when installed on the nozzle, the sleeve forms an interference fit with the nozzle.

In one example, a connection (or connection assembly) for a radiator is provided. The connection can include a first component that can operate as an inlet or outlet. The first component may have a first body with a hollow generally circular cross-sectional profile, a main portion that is centered on a main axis, and a second portion that is centered on a second axis that is angled relative to the main axis in a range of about 25 degrees to about 90 degrees. The first component can include a bird beak cut section forming a first mating surface at an end of the first body. The connection also can include a second component that can operate as a manifold. The second component may have a second body with a generally rectangular cross sectional profile and an inner surface that defines both a hollow interior and an aperture. The aperture can extend along at least two sides of the second component, and be defined by a portion of the inner surface of the second body. The aperture or the portion of the inner surface of the second body that defines the aperture can be angled relative to a planar surface of the second body at non-perpendicular angle. The aperture may have a diameter that is sized to matingly couple to (e.g., mate with) the first mating surface of the first component. The connection also can include a weld seam disposed at the first mating surface and that can couple the first component to the second component to form a fluidic seal between the hollow interior of the second component and an exterior area while defining a fluid flow path through the first and second components.

The second axis of the second portion of the first component can be oriented at 135 degrees to the first axis of the first portion of the first component. The first component can have an outer diameter that is in a range of about 75 mm to about 105 mm. The bird beak cut section of the first component can define a 90 degree cut, and the second component has a rectangular cross-sectional profile with side walls that are oriented at 90 degrees to each other.

In another example, a radiator (or radiator assembly) can include the connection described above. The first and second components may be formed from steel or aluminum. The weld seam can seal the first mating surface to prevent fluid from flowing from inside the radiator to outside the radiator via the joint between the first component and the second component. The weld seam may resist more than 500 thermal cycles without cracking, and more than 200 pounds per square inch (PSI) of fluid pressure without leaking.

The first component, the weld seam, and the second component can have stress concentration factors that are about evenly distributed across the first component, the weld seam, and the second component. The first component and the second component each can have a width that is in a range of about 1 mm to about 4 mm.

In another example, a radiator (or radiator assembly) is provided. This radiator may include a first component that can operate as an inlet or outlet. The first component may have a hollow first body with a generally circular cross-sectional profile. The first component can have a main portion that is centered on a main axis and a second portion that is centered on a second axis that is angled relative to the main axis by an amount in a range of about 25 degrees to about 90 degrees. The first component may include a bird beak cut section at an end of the first body that forms a first mating surface. The radiator may include a second component that can operate as a manifold. The second component may have a hollow second body with a generally rectangular cross sectional profile and an inner surface that defines an aperture. The aperture can extend along at least two sides of the second component and be defined by a portion of the second body inner surface and relative to a planar surface of the second body being angled other than perpendicular. The aperture can have a diameter sized to matingly couple to the first mating surface. The radiator also may include a weld seam disposed at the first mating surface and that can couple the first component to the second component to thereby form a fluidic seal between the hollow interior and an exterior space while defining a fluid flow path through the first and second components, the first component, the second component. The weld seam can define a bird beak joint.

The second axis of the second portion of the first component can be oriented at 135 degrees to the first axis of the first portion of the first component. The first component may have an outer diameter that is in a range of about 75 mm to about 105 mm. The bird beak cut section of the first component may define a 90 degree cut. The second component can have a rectangular cross-sectional profile with side walls that are oriented at 90 degrees to each other. The first and second components may be formed from steel or aluminum.

The weld seam can seal the first mating surface to prevent fluid from flowing from inside the radiator to outside the radiator via the joint between the first component and the second component. The weld seam can resist more than 500 thermal cycles without cracking, and more than 200 pounds per square inch (PSI) of fluid pressure without leaking.

The first component, the weld seam, and the second component can have stress concentration factors that are about evenly distributed across the first component, the weld seam, and the second component. The first component and the second component each can have a width that is in a range of about 1 mm to about 4 mm. The bird beak joint can be formed at a bird beak cut in the first component. The bird beak cut may be formed by an upper face and a lower face in the first component that are divided at an angled transition of the upper face to the lower face.

As used herein, an element or step recited in the singular and proceeded with the word "a" or "an" do not exclude plural of said elements or steps, unless such exclusion is indicated. Furthermore, references to "one embodiment" of the invention do not exclude the existence of additional embodiments that also incorporate the recited features. Moreover, unless explicitly stated to the contrary, embodiments "comprising," "including," or "having" an element or a plurality of elements having a particular property may include additional such elements not having that property. The terms "including" and "in which" are used as the plain-language equivalents of the respective terms "comprising" and "wherein." Moreover, the terms "first," "second," and "third," etc. are used merely as labels, and are not intended to impose numerical requirements or a particular positional order on their objects. As used herein, the term "approximately" is means plus or minus five percent of a given value or range unless otherwise indicated.

This written description uses examples to disclose the invention, including the best mode, and also to enable a person of ordinary skill in the relevant art to practice the invention, including making and using devices or systems and performing the incorporated methods. The patentable scope of the invention is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

What is claimed is:

1. A connection for a radiator, the connection comprising:

a first component configured as an inlet or outlet, the first component having a first body with a hollow generally circular cross-sectional profile, the first component having a main portion that is centered on a main axis and a second portion that is centered on a second axis that is angled relative to the main axis in a range of about 25 degrees to about 90 degrees, the first component including a bird beak cut section forming a first mating surface at an end of the first body;

a second component configured as a manifold, the second component having a second body with a generally rectangular cross-sectional profile and an inner surface that defines both a hollow interior and an aperture, the aperture extending along at least two sides of the second component, the aperture defined by a portion of the inner surface of the second body, the aperture or the portion of the inner surface of the second body that defines the aperture being angled relative to a planar surface of the second body at non-perpendicular angle, the aperture having a diameter that is sized to matingly couple to the first mating surface of the first component; and a weld seam disposed at the first mating surface and that is configured to couple the first component to the second component to form a fluidic seal between the hollow interior of the second component and an exterior area while defining a fluid flow path through the first and second components.

2. The connection of claim 1, wherein the second axis of the second portion of the first component is oriented at 135 degrees to the first axis of the first portion of the first component.

3. The connection of claim 1, wherein the first component has an outer diameter that is in a range of about 75 millimeters (mm) to about 105 mm.

4. The connection of claim 1, wherein the bird beak cut section of the first component defines a 90 degree cut, and the second component has a rectangular cross-sectional profile with side walls that are oriented at 90 degrees to each other.

5. A radiator comprising the connection of claim 1.

6. The radiator of claim 5, wherein the first and second components are formed from steel, aluminum, or brass.

7. The radiator of claim 5, wherein the weld seam seals the first mating surface to prevent fluid from flowing from inside the radiator to outside the radiator via a joint between the first component and the second component.

8. The radiator of claim 5, wherein the weld seam is configured to resist more than 500 thermal cycles without cracking, and more than 200 pounds per square inch (PSI) of fluid pressure without leaking.

9. The radiator of claim 5, wherein the first component, the weld seam, and the second component have stress concentration factors that are about evenly distributed across the first component, the weld seam, and the second component.

10. The radiator of claim 5, wherein the first component and the second component each have a thickness that is in a range of about 1 mm to about 4 mm.

11. A radiator, comprising:

a first component configured as an inlet or outlet, the first component having a hollow first body with a generally circular cross-sectional profile, the first component having a main portion that is centered on a main axis and a second portion that is centered on a second axis that is angled relative to the main axis by an amount in a range of about 25 degrees to about 90 degrees, the first component including a bird beak cut section at an end of the first body that forms a first mating surface;

a second component configured as a manifold, the second component having a hollow second body with a generally rectangular cross-sectional profile and an inner surface that defines an aperture, the aperture extending along at least two sides of the second component, the aperture defined by a portion of the second body inner surface and relative to a planar surface of the second body being angled other than perpendicular, the aperture having a diameter sized to matingly couple to the first mating surface; and a weld seam disposed at the first mating surface and that is configured to couple the first component to the second component to thereby form a fluidic seal between a hollow interior and an exterior space while defining a fluid flow path through the first and second components, the first component, the second component, and the weld seam defining a bird beak joint.

12. The radiator of claim 11, wherein the second axis of the second portion of the first component is oriented at 135 degrees to the first axis of the first portion of the first component.

13. The radiator of claim 11, wherein the first component has an outer diameter that is in a range of about 75 millimeters (mm) to about 105 mm.

14. The radiator of claim 11, wherein the bird beak cut section of the first component defines a 90 degree cut, and the second component has a rectangular cross-sectional profile with side walls that are oriented at 90 degrees to each other.

15. The radiator of claim 11, wherein the first and second components are formed from steel, aluminum, or brass.

16. The radiator of claim 11, wherein the weld seam seals the first mating surface to prevent fluid from flowing from inside the radiator to outside the radiator via the joint between the first component and the second component.

17. The radiator of claim 11, wherein the weld seam is configured to resist more than 500 thermal cycles without cracking, and more than 200 pounds per square inch (PSI) of fluid pressure without leaking.

18. The radiator of claim 11, wherein the first component, the weld seam, and the second component have stress concentration factors that are about evenly distributed across the first component, the weld seam, and the second component.

19. The radiator of claim 11, wherein the first component and the second component each have a thickness that is in a range of about 1 mm to about 4 mm.

20. The radiator of claim 11, wherein the bird beak joint is formed at a bird beak cut in the first component, the bird beak cut formed by an upper face and a lower face in the first component that are divided at an angled transition of the upper face to the lower face.

* * * * *